United States Patent [19]

Holding

[11] 4,430,971

[45] Feb. 14, 1984

[54] INTERNAL COMBUSTION ENGINE

[76] Inventor: Norman Holding, 91 Liverpool Rd., Longton, Preston, Lancashire, England

[21] Appl. No.: 335,103

[22] Filed: Dec. 28, 1981

[51] Int. Cl.[3] ..... F01L 9/10

[52] U.S. Cl. ..... 123/90.34; 123/90.27; 123/196 A

[58] Field of Search ..... 123/90.34, 90.27, 90.33, 123/195 A, 195 R, 90.24, 196 A, 196 R; 210/168, 171, 445, 446, 450, 433.1

[56] References Cited

U.S. PATENT DOCUMENTS

| | | | |
|---|---|---|---|
| 1,426,918 | 8/1922 | Shover | 123/90.33 |
| 1,428,177 | 9/1922 | Mead | 123/90.34 |
| 1,687,827 | 10/1928 | Buxton | 123/90.34 |
| 2,119,619 | 6/1938 | Bauer | 210/168 |
| 2,231,722 | 2/1941 | Johnson | 210/168 |
| 2,862,623 | 12/1958 | Werner | 210/450 |
| 3,412,720 | 11/1968 | Binder | 123/90.34 |
| 3,557,767 | 1/1971 | Green | 123/196 A |
| 3,628,513 | 12/1971 | Grosseau | 123/90.27 |

FOREIGN PATENT DOCUMENTS

| | | | |
|---|---|---|---|
| 2240094 | 2/1974 | Fed. Rep. of Germany | 123/196 A |
| 257395 | 7/1925 | United Kingdom | 123/90.34 |
| 344768 | 3/1931 | United Kingdom | 210/168 |

OTHER PUBLICATIONS

"Oil Systems" by Tony Murphy from Motorcycle Repair Manual, Oct. 1972, p. 146, Crossroads Press.

*Primary Examiner*—Ira S. Lazarus
*Assistant Examiner*—R. S. Bailey
*Attorney, Agent, or Firm*—James E. Nilles

[57] ABSTRACT

For an internal combustion engine having oilspray lubrication of an overhead camshaft an assembly is provided which comprises a central filter case (21) which can connect by a nipple (31) with an existing oil supply conduit (15) in an engine to receive oil therefrom and on a downstream side of a filter screen (23) connects with pipes **(20*a*, 20*b*) which have apertures whence oil sprays (36)** can issue.

3 Claims, 5 Drawing Figures

INTERNAL COMBUSTION ENGINE

BACKGROUND OF THE INVENTION

This invention relates to an internal combustion engine having an overhead camshaft to parts of which lubrication is applied by spraying.

Lubrication of the interface between each cam of an overhead camshaft and the component against which the cam operates e.g. valve stem, tappet, rocker, ultimately controlling the aspiration valves of an internal combustion engine, is often effected by spraying.

The primary objective of such lubrication is to direct a spray of oil on to an intended area of the cam and/or the component against which the cam directly operates. Effective lubrication of the said interface is mainly dependent on maintaining a sufficient oil spray onto the intended area.

The spray is usually emitted from a small hole or jet in a conduit situated conveniently near the said area and fed from the engine oil pump by pipes and/or oilways in the cylinder block and head.

An average engine oil filter is effective in preventing the flow, in the general oil circuits, of particles which would be injurious to sleeve and rolling bearings.

However, it does allow passage of minute particles which in time, become coagulated on the walls of pipes or oilways to form areas of "crust".

Any pieces of this "crust" subsequently dislodged are able to circulate the oilways or pipes and may reach lubrication areas without being influenced by the filter.

While such pieces are usually too soft by their nature to injure sleeve or rolling bearings, they have enough size and tenacity to block the spray holes of the spray lubrication system, thereby starving the cams of their lubrication.

The said pieces may become dislodged purely by the flow of oil in the pipes or oilways, but their incidence is enhanced by the addition of or change to a higher detergent oil than normally used. This is particularly noticeable after the engine has been "flushed out".

SUMMARY OF THE INVENTION

An object of the present invention is to provide an O.H.C. internal combustion engine wherein this problem is obviated or minimised.

Accordingly the invention provides an internal combustion engine having an overhead camshaft and an oil supply to apertures for spray lubrication of the camshaft, filter means being provided in the path of the oil flow to prevent or discourage solid material from reaching the spray apertures.

Because the chance of such a blockage increases with the length of conduit such as piping and/or oilways leading to the spray holes the filter should be positioned as far downstream in the oil stream flow as conditions allow; preferably in the final stage, just before the spray holes, in order to minimise the likelihood of blockage.

THE DRAWINGS

The invention will be described further, by way of example, with reference to the accompanying drawings wherein:

FIG. 1 is a perspective view of an engine modified in accordance with the present invention;

FIGS. 2 and 2*a* are fragmentary views, respectively a perspective view of a spray conduit and a part-sectional view showing the conduit connected to a cylinder head in a conventional internal combustion engine;

FIG. 3 is a view similar to that of FIG. 2 but showing the conduit modified and connected to a filter, illustrated in exploded form; and FIG. 4 is a view similar to that of FIG. 2(*a*) but showing the filter in position connecting the conduit to the cylinder block of an engine.

DESCRIPTION OF A PREFERRED EMBODIMENT

The chosen example of engine of the invention is the British Ford Petrol engine 1600 OHC or 2000 OHC currently in production.

Figure 1:
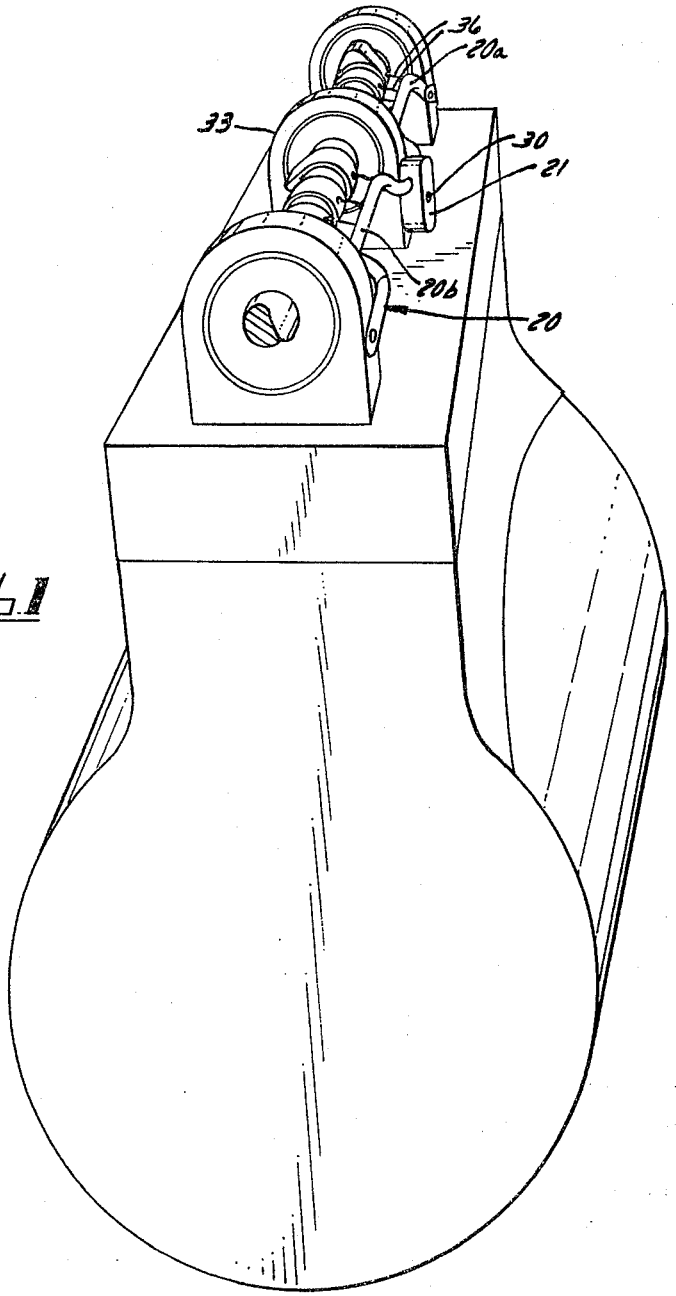
Figures 2, 2A:
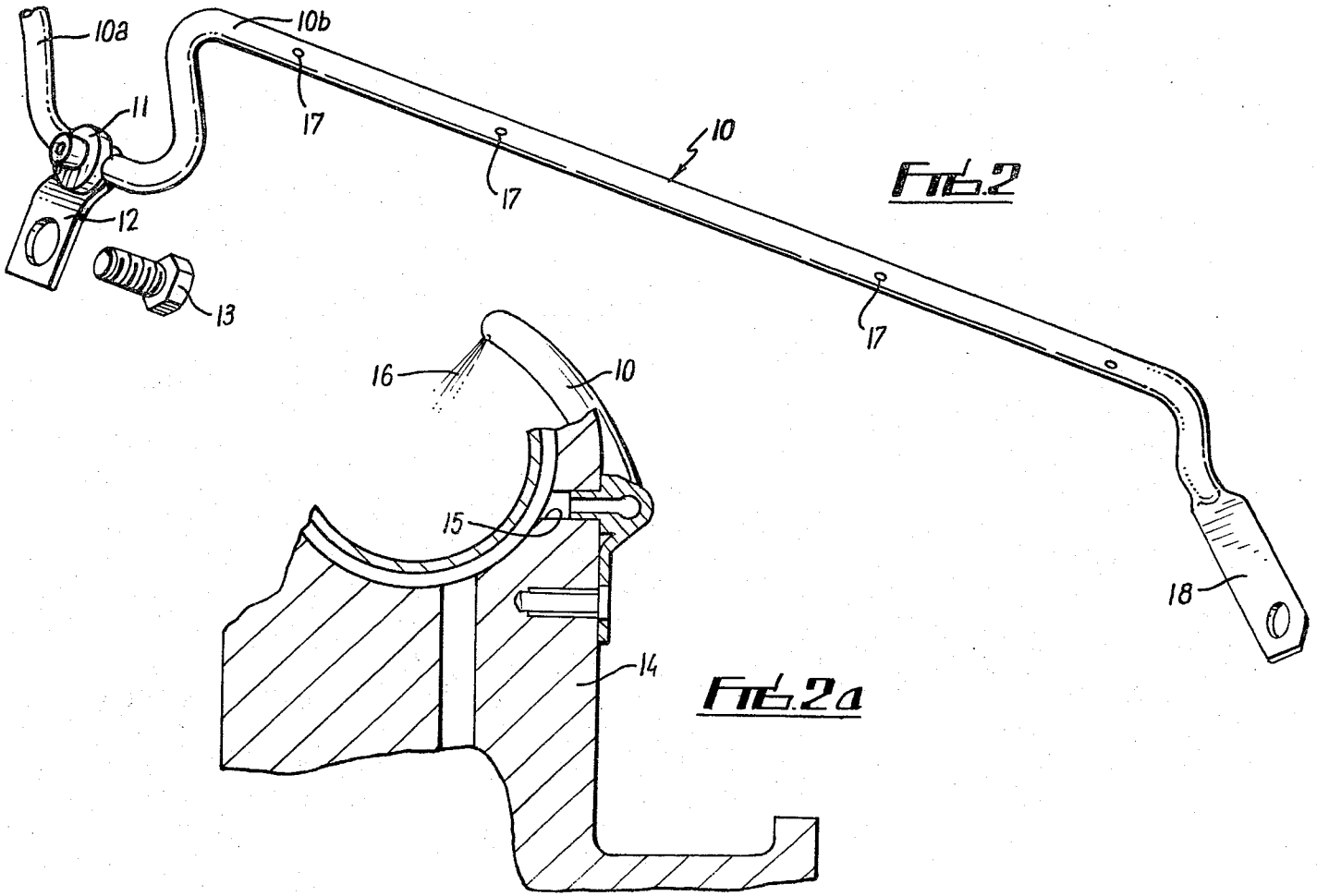

In this style of engine, camshaft lubrication oil ascends from the engine oil pump and filter, both situated low down near the sump, through an oilway in the cylinder block, through a perforation in the cylinder head gasket, through an oilway in the cylinder head into the camshaft centre bearing pedestal from which it passes through a horizontally drilled oilway into the spray pipe assembly (FIG. 2).

FIG. 2 is a pictorial view of an assembly consisting of a spray pipe 10, nipple 11 and bracket 12. The assembly is that Ford Part which in the United Kingdom is given No. 1490126, and which in Europe and in the U.S.A. is marked 70 HM 6578AE and DIFZ-6578A, respectively. The assembly is secured by a bolt 13 to the side of the camshaft centre bearing pedestal 14 (FIG. 2*a*) while the nipple 11 enters a horizontally drilled oilway 15, to receive and transmit oil to the pipe 10. From this point oil flows into the fore and aft halves of the pipe **10*a* 10*b* finally to emerge as a spray 16 from each of eight spray holes 17**, one spray lubricating each of eight cams (not illustrated).

The ends 18 of the pipe are sealed, and secured by one bolt each (not shown) to the camshaft fore and aft bearing pedestals (also not shown).

It is this existing system which is vulnerable to blocking of the spray holes 17.

Another hazardous feature of this particular engine lies in the fact that the oil passes from an oilway in the cylinder block to an oilway in the cylinder head via the cylinder head gasket. Therefore, very special care must be taken, when changing the cylinder head gasket for maintenance purposes, that foreign matter, such as scrapings, does not enter the oilway in either the cylinder block or the cylinder head, for on re-starting the engine, such matter could be carried along by the oil and block one or more of the spray holes.

Figure 3:
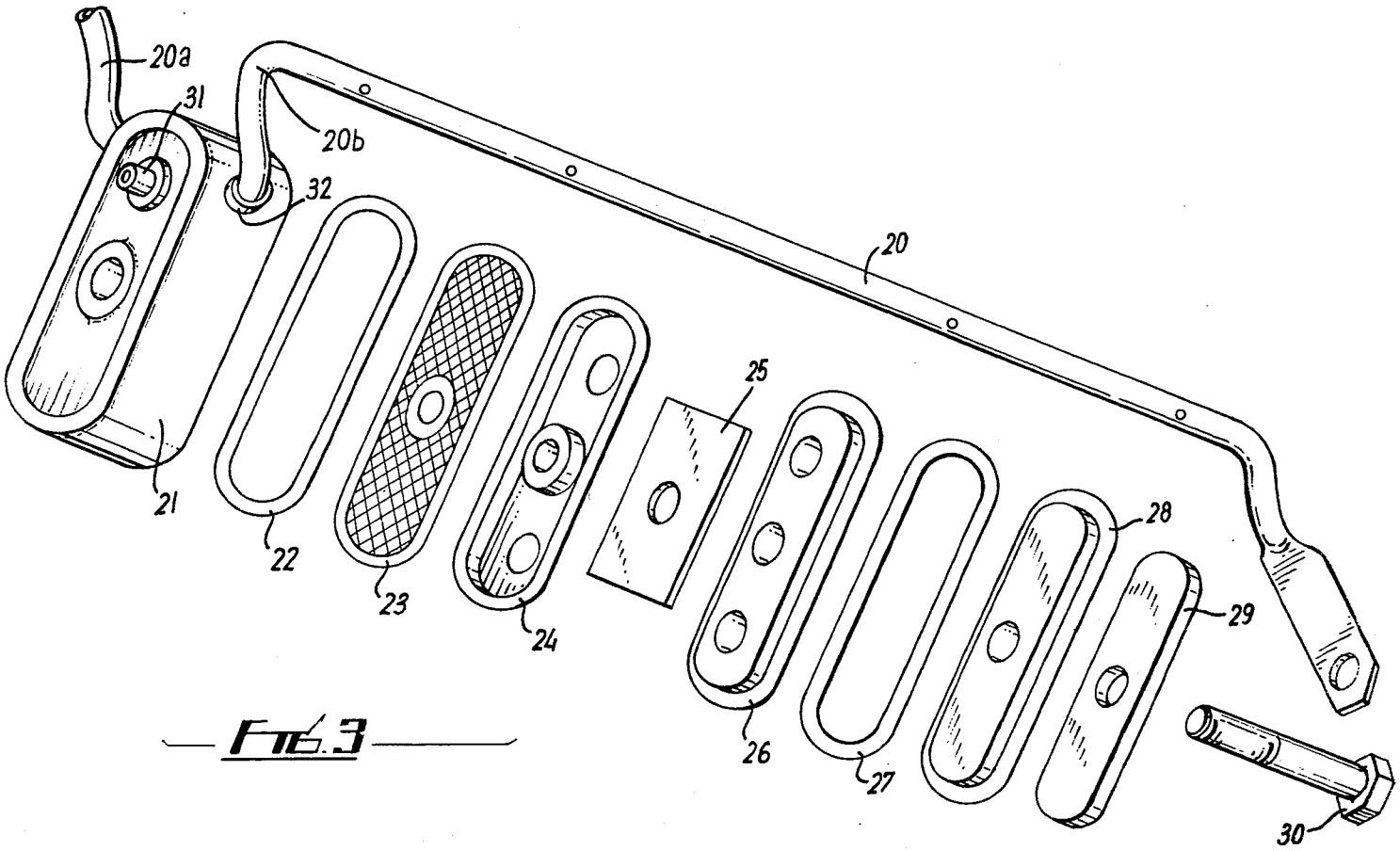
Figure 4:
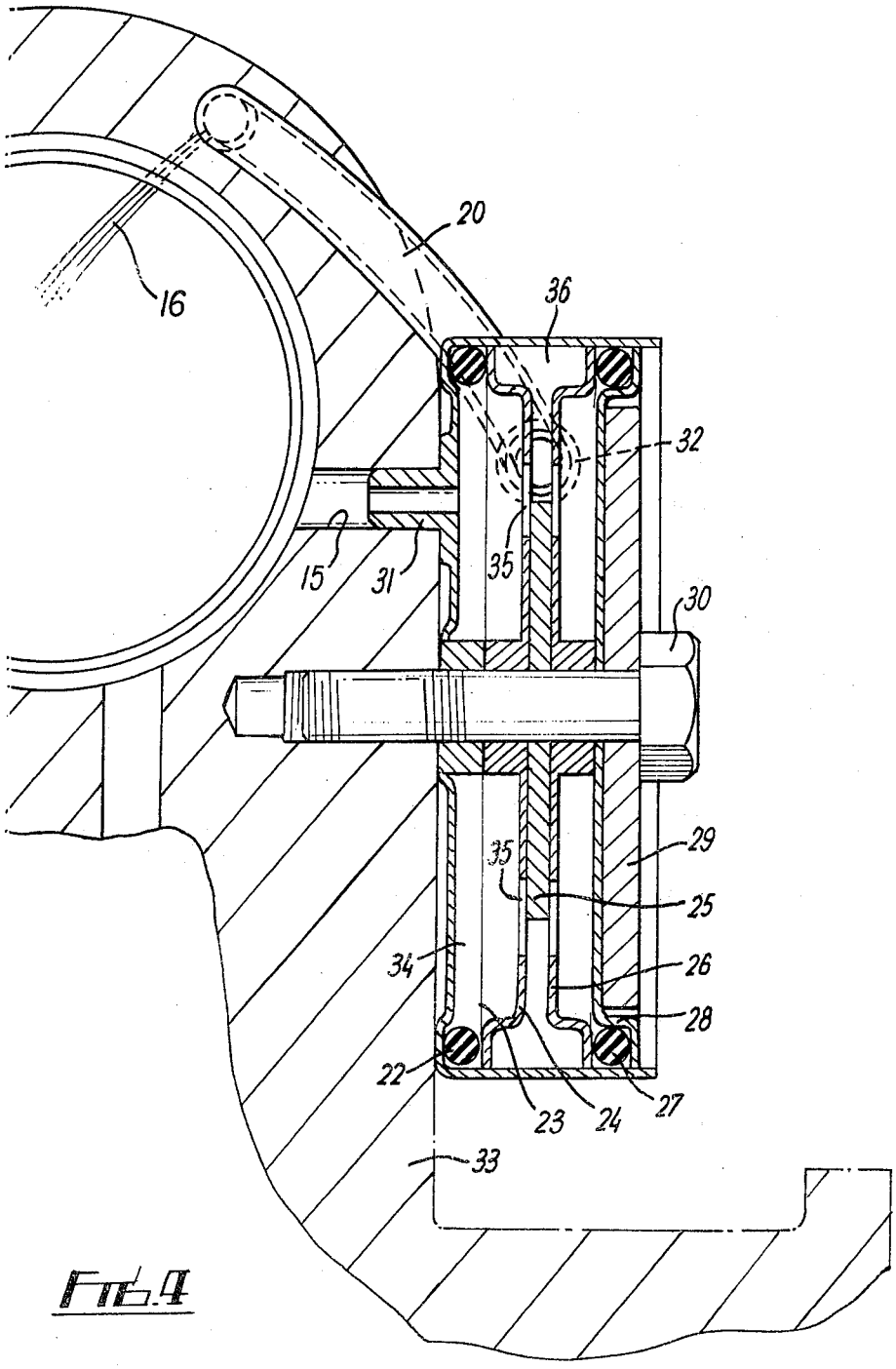

Referring simultaneously to FIGS. 3 and 4 in an engine in accordance with the invention the innermost ends of pipe halves **20*a*, 20*b* are removed by cutting and the two ends resulting are secured by brazing into two holes, one in each side of a filter case 21 in such a manner that the said ends do not protrude into the inside of the case 21 but the bores of the pipes 20*a*, 20*b* connect with the inside of the case 21. When the case 21 is being made, holes for the ends of pipes 20*a* 20*b* are punched out to form a short tubular spigot 32 which facilitates brazing of the pipe ends to the case 21 and increases the tolerance in the length to which the pipe halves 20*a*, 20*b*** have to be cut.

Filter components are assembled in the case (1) in the following order:

'O' Ring 22
Screen 23
Plate 24

Spacer 25
Plate 26
'O' Ring 27
Lid 28
Yoke 29

This assembly is then secured to the camshaft centre bearing pedestal by a bolt 30 which may be tightened solidly and yet apply a dimensionally controlled compression to the two 'O' Ring seals 22,27 because of the limit to its movement imposed by the solid centre parts of the various components forming a stack around it.

At the same time a nipple 31 on the case 21 enters the horizontally drilled hole 15 (FIG. 4) in the camshaft centre bearing pedestal 33 to admit oil to the filter case 21.

The ends of the pipes 20*a*, 20*b* are secured as before to the camshaft fore and aft bearing pedestals (not shown).

Now referring to FIG. 4. On starting the engine, oil passes from the drilled hole 15 in the camshaft centre bearing pedestal 33 through the nipple 31 into chamber 34 from where any subsequent flow must be through filter screens 23 the whole area of which is available to pass oil but to stop particles greater than a given size and to collect such particles in chamber 34.

The now filtered oil flows through holes 35 in plate 24 into annulus 36 into the bores of pipe 20 and is finally emitted from the spray holes onto the intended area of the cam.

I claim:

1. A lubricating system for an overhead camshaft of an internal combustion engine that has a cylinder block and a cylinder head wherein there are communicated passages for oil under pressure which lead to an outlet at a surface on the cylinder head, said lubricating system comprising a conduit that extends lengthwise along the camshaft and has ports at spaced intervals along its length from which oil is sprayed towards the camshaft to lubricate interfaces between it and parts that it engages, said conduit having one end portion communicated with said outlet and being supported at its said one end portion by means of a bolt threaded into a hole in the cylinder head that opens to said surface in spaced relation to said outlet, said lubricating system being characterized by:

A. a case having
  (1) a front wall,
  (2) an opposite rear wall wherein there is an inlet, and
  (3) a side wall extending between said front and rear walls and sealingly connected with them;

B. said front and rear walls having aligned apertures through which said bolt extends for securing the case to the cylinder head with its said rear wall overlying said surface and said inlet in register with said outlet;

C. means on said rear wall for sealingly connecting said inlet with said outlet;

D. annular means on the case, spaced from said rear wall, providing a sealed connection between the case and said one end portion of the conduit whereby that end portion is supported by the case and the interior of the conduit is communicated with the interior of the case; and E. a filter element in said case through which oil is constrained to pass in flowing from said inlet to the interior of the conduit.

2. The lubricating system of claim 1, further characterized by:

said annular means comprising an outwardly projecting annular spigot formed integrally with the side wall and in which said end portion of the conduit is closely received.

3. The lubricating system of claim 1, further characterized by:

said filter element comprising a substantially flat screen that is substantially parallel to said front and rear walls and is spaced from the front wall.

* * * * *